US011333400B2

(12) United States Patent
Choi

(10) Patent No.: US 11,333,400 B2
(45) Date of Patent: May 17, 2022

(54) HOT WATER STORAGE-TYPE BOILER HAVING BOTH HEAT AMOUNT PROPORTIONAL CONTROL FUNCTION AND BACKFLOW PREVENTION FUNCTION

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 113 days.

(21) Appl. No.: 16/655,165

(22) Filed: Oct. 16, 2019

(65) Prior Publication Data

US 2020/0064025 A1 Feb. 27, 2020

Related U.S. Application Data

(63) Continuation of application No. PCT/KR2019/000383, filed on Jan. 10, 2019.

(30) Foreign Application Priority Data

Mar. 19, 2018 (KR) ..... 10-2018-0031394

(51) Int. Cl.

| | |
|---|---|
| ***F24H 9/20*** | (2022.01) |
| ***F23L 3/00*** | (2006.01) |
| ***F23L 13/04*** | (2006.01) |
| ***F24H 1/18*** | (2022.01) |
| ***F24H 1/20*** | (2022.01) |

(52) U.S. Cl.

CPC ..... *F24H 9/2042* (2013.01); *F23L 3/00* (2013.01); *F23L 13/04* (2013.01); *F24H 1/186* (2013.01); *F24H 1/208* (2013.01); *F24H 9/2035* (2013.01)

(58) Field of Classification Search

CPC ..... F24H 9/2042

See application file for complete search history.

(56) References Cited

U.S. PATENT DOCUMENTS

| | | | | |
|---|---|---|---|---|
| 2010/0095905 | A1* | 4/2010 | Smelcer | F23D 14/02 122/14.2 |
| 2018/0163994 | A1* | 6/2018 | Suzuki | F23N 5/203 |
| 2018/0187921 | A1* | 7/2018 | Ojiro | F23K 5/00 |
| 2018/0313577 | A1* | 11/2018 | Ojiro | F23L 5/02 |

FOREIGN PATENT DOCUMENTS

| | | | | |
|---|---|---|---|---|
| CN | 102563159 | A * | 7/2012 | |
| EP | 2 871 393 | A1 | 5/2015 | |
| JP | 2017-020693 | A | 1/2017 | |
| KR | 10-0724601 | B1 | 5/2007 | |
| WO | WO-2017006758 | A1 * | 1/2017 | F24H 9/2042 |

OTHER PUBLICATIONS

CN 102563159A—machine translation (Year: 2010).*

International Search Report issued in PCT/KR2019/000383; dated May 10, 2019.

* cited by examiner

*Primary Examiner* — Nathaniel Herzfeld

(74) *Attorney, Agent, or Firm* — Studebaker & Brackett PC

(57) ABSTRACT

The present invention provides a hot water storage-type boiler having both a heat amount proportional control function and a backflow prevention function to prevent a backflow of exhaust gas with a simple structure. In the present invention, since a check valve is integrally coupled to a burner duct, there is an effect of convenient assembly. In addition, since the check valve is built in the burner duct, the check valve does not protrude to the outside, thereby having an effect that a separate space is not required.

4 Claims, 7 Drawing Sheets

HOT WATER STORAGE-TYPE BOILER HAVING BOTH HEAT AMOUNT PROPORTIONAL CONTROL FUNCTION AND BACKFLOW PREVENTION FUNCTION

CROSS-REFERENCE TO RELATED APPLICATIONS

This application is a Continuation of International Application No. PCT/KR2019/000383 filed on Jan. 10, 2019, which claims benefit of priority to Korean Patent Application No. 10-2018-0031394 filed on Mar. 19, 2018, the entire content of which is incorporated herein by reference.

TECHNICAL FIELD

The present invention relates to a hot water storage-type boiler having both a heat amount proportional control function and a backflow prevention function and, more specifically, to a hot water storage-type boiler having both a heat amount proportional control function and a backflow prevention function to prevent backflow of exhaust gas with a simple structure.

BACKGROUND ART

In general, gas boilers use gas as fuel and water as heat medium for heating. Especially in the case of a boiler for combined use of hot water, circulation water for heating is circulated inside the boiler through a three-way valve, and the boiler is a combustor that heats supplying water in a form of indirect heat exchange to enable using hot water as well. These gas boilers are classified into instantaneous-type boilers and hot water storage-type boilers according to a hot water supplying method.

An instantaneous-type boiler is heated by the main heat exchanger or hot water storage heat exchanger in the boiler when needed to supply hot water. Since such an instantaneous-type boiler quickly converts cold water into hot water by being instantaneously heated by a large-capacity electric heater, and a separate hot-water tank is not used, whereby a small sized boiler may also be hung on a wall. However, in the case of indoor heating and the like using the instantaneous-type boiler, there is a problem in that a large amount of electricity is consumed by using the large-capacity electric heater, incurring an excessively high cost for heating.

The hot water storage-type boiler is designed to store hot water in a hot water storage tank so that hot water may be used instantaneously when needed, which is different from the instantaneous-type boiler that operates a burner and generates hot water when needed. The hot water storage-type boiler is configured to provide with a heat exchanger inside the hot water storage tank so that the direct water stored in the hot water storage tank is heated to make hot water of a suitable high temperature by the heat exchange unit. Accordingly, users may use hot water or water for heating instantaneously.

FIG. 1 is a view illustrating a conventional gas boiler. Referring to FIG. 1, in the conventional gas boiler, a burner 3 is installed to burn air and gas supplied through an intake duct depending on an operation of a blower 2 at the upper portion of the combustor 1. In addition, a sensible heat exchanger 5 and a latent heat exchanger 6 are arranged in order under the burner 3. Exhaust gas passing through the latent heat exchanger 6 is discharged to the outside through an exhaust duct 7. Condensate water generated in the heat exchange process is dropped into an exhaust hood 8 and collected in the condensate-water receiver 10, and then discharged to the outside.

Since such a conventional gas boiler does not have a separate backflow prevention means for preventing the exhaust gas combusted in the burner of the combustor from backflowing in a direction of the intake duct, the exhaust gas flows back in the direction of the intake duct as it is. This situation decreases the efficiency of the combustor and causes a problem in that exhaust gas may flow back into the house.

Some boilers install a separate damper on the outside of the combustor to solve this problem, but such a damper also have a problem that requires a separate space for installing the damper on the outside of the combustor.

DISCLOSURE

Technical Problem

An objective of the present invention for solving the problems of the related art as described above is to provide a hot water storage-type boiler having both a heat amount proportional control function and a backflow prevention function to prevent backflow of exhaust gas with a simple structure.

Technical Solution

In order to achieve the objective of the present Invention, there is a hot water storage-type boiler having both a heat amount proportional control function and a backflow prevention function. The hot water storage-type boiler includes: a casing having a space therein and providing an independent firebox on an upper portion of the space; a burner body mounted on an upper portion of the firebox and provided therein with a burner to inject a flame into the firebox; a blower body connected to the burner body and provided therein with a blower to send air to the burner body; and a check valve provided on one side of the burner body coupled to the blower body or on one side of the blower body coupled to the burner body, and moving the air supplied from the blower toward the burner, wherein the check valve is configured to be opened by pressure of the air supplied from the blower and to be closed by pressure of gas generated by the flame injected by the burner.

In addition, a blower duct may extend at one side of the blower body to deliver outside air sent by the blower to the burner body, the burner body may have a burner duct extending in a direction of the blower duct to be connected to the blower duct, and the check valve may be provided inside the blower duct or the burner duct.

In addition, the check valve may include: a valve body fitted into an inner circumferential edge of the blower duct or the burner duct and having a penetration part provided on one surface thereof; and an opening and closing part which is provided to open and close the penetration part and is hinge-coupled to the valve body to be opened in a direction of the burner.

In addition, the hot water storage-type boiler may further include a guider protruding toward the burner along an edge of the valve body, wherein the guider protrudes in an inclined state to recede from the edge of the valve body toward a lower side of the valve body, and the opening and closing part is closely adhered to be inclined to the guider in a hinged state on an upper side of the valve body.

In addition, a weight plate may be provided in the opening and closing part.

In addition, the weight plate may be detachably coupled to the opening and closing part and configured to adjust weights of the weight plate.

In addition, an inner recess may be provided inside the opening and closing part in contact with the valve body, and a sealing unit may be mounted in the inner recess.

In addition, the sealing unit may have a double protrusion.

In addition, the hot water storage-type boiler may further include: a plurality of fire tubes in which one side thereof is connected to a lower surface of the firebox and the other side thereof extends to a lower direction of the space; and an exhaust gas part provided at a lower portion of the casing and connected to the fire tubes, wherein the flame injected by the burner is moved along insides of the fire tubes while heating the fire tubes and then moved to the exhaust gas part, and water supplied to one side of the space is moved to the other side of the space after passing through the space.

Advantageous Effects

According to the present invention, since an opening area of a check valve is variable by a pressure of air supplied from a blower, an amount of air supplied from the blower to a burner body is also variable, through which an effect of heat amount proportional control is made possible. In addition, when the check valve closes a penetrating unit by a pressure of gas generated by the burner, there is an effect of blocking the gas generated by the burner from backflowing.

In addition, since the check valve is integrally coupled to a burner duct, there is a convenient effect of assembly. Further, since the check valve is built in the burner duct, the check valve does not protrude to the outside, thereby having an effect that a separate space is not needed.

In addition, since a weight plate is provided to be detachable to an opening and closing part of the check valve, there is an effect that the turndown ratio may be controlled by adjusting the weights of the weight plate.

In addition, since an inner side sealing unit mounted on the opening and closing part of the check valve is provided with a double protrusion for the inner side sealing unit to be in close contact with a guider, there is an effect that airtightness is improved. In addition, the opening and closing part and the inner side sealing unit are manufactured by double injection, thus there is an effect of reducing the production cost.

DESCRIPTION OF THE MAIN NUMERALS IN THE DRAWINGS

Figure 1:
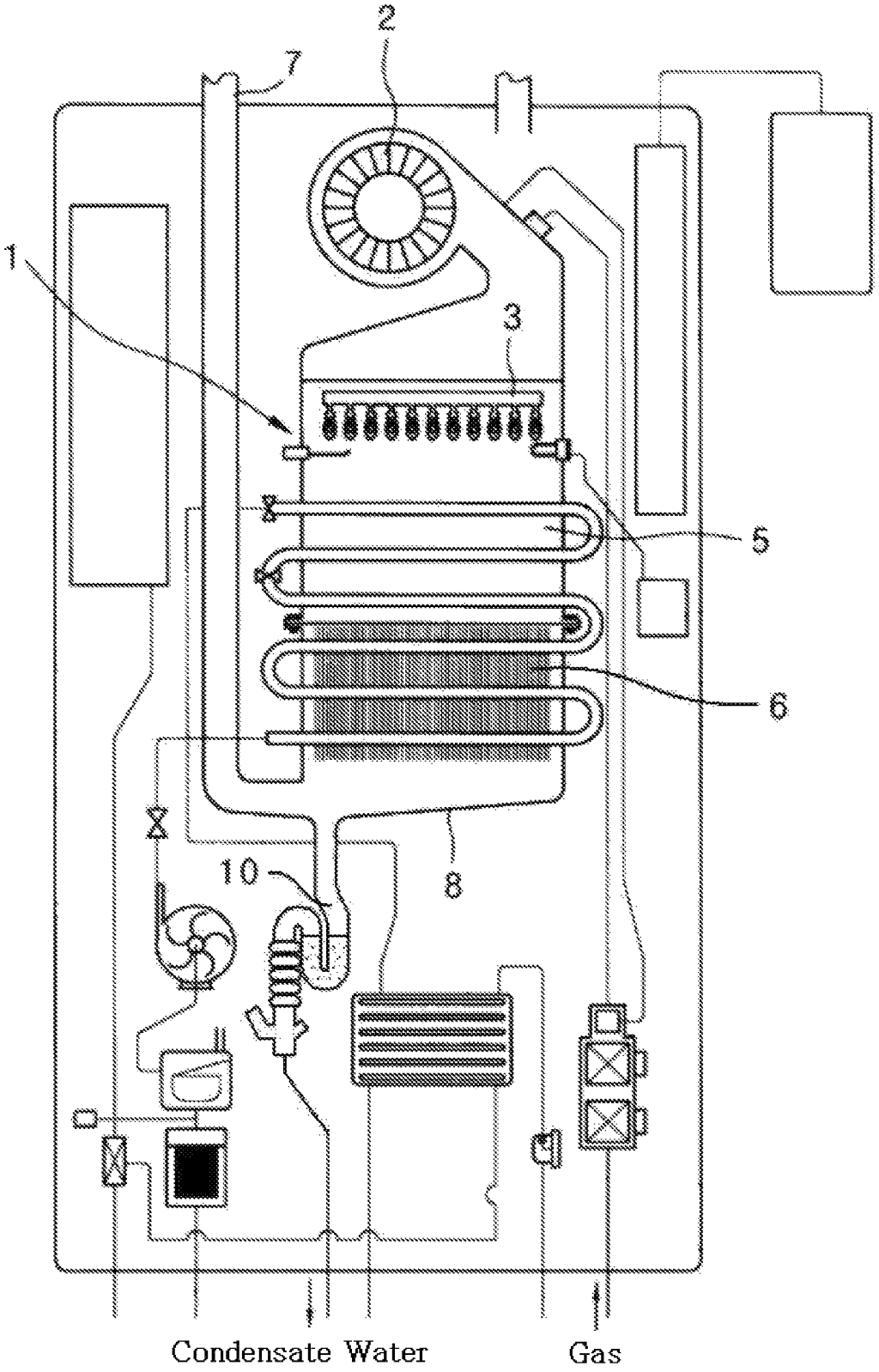
FIG. 1 is a view illustrating a conventional gas boiler.

1000: Hot water storage-type boiler having both heat amount proportional control function and backflow prevention function
100: Casing 102: Inlet part
104: Outlet part 110: Space
120: Firebox 122: lower surface unit of firebox
200: Burner body 202: Burner duct
210: Burner 300: Blower body
302: Blower duct 304: Blower pipe
310: Blower 400: Check valve
410: Valve body 410*a*: Penetration part
412: Guider 420: Opening and closing part
420*a*: Outer recess 420*b*: Inner recess
422: Hinge pin 424: Outer side sealing unit
426: Inner side sealing unit 426*a*: Fitting unit
426*b*: First protrusion unit 426*c*: Second protrusion unit
430: Weight plate 432: Coupling bolt
500: Fire tube 600: Exhaust gas part
610: Exhaust gas duct

BEST MODE

Hereinafter, with reference to the accompanying drawings a hot water storage-type boiler having both a heat amount proportional control function and a backflow prevention function according to a preferred embodiment of the present invention will be described in more detail.

Figure 2:
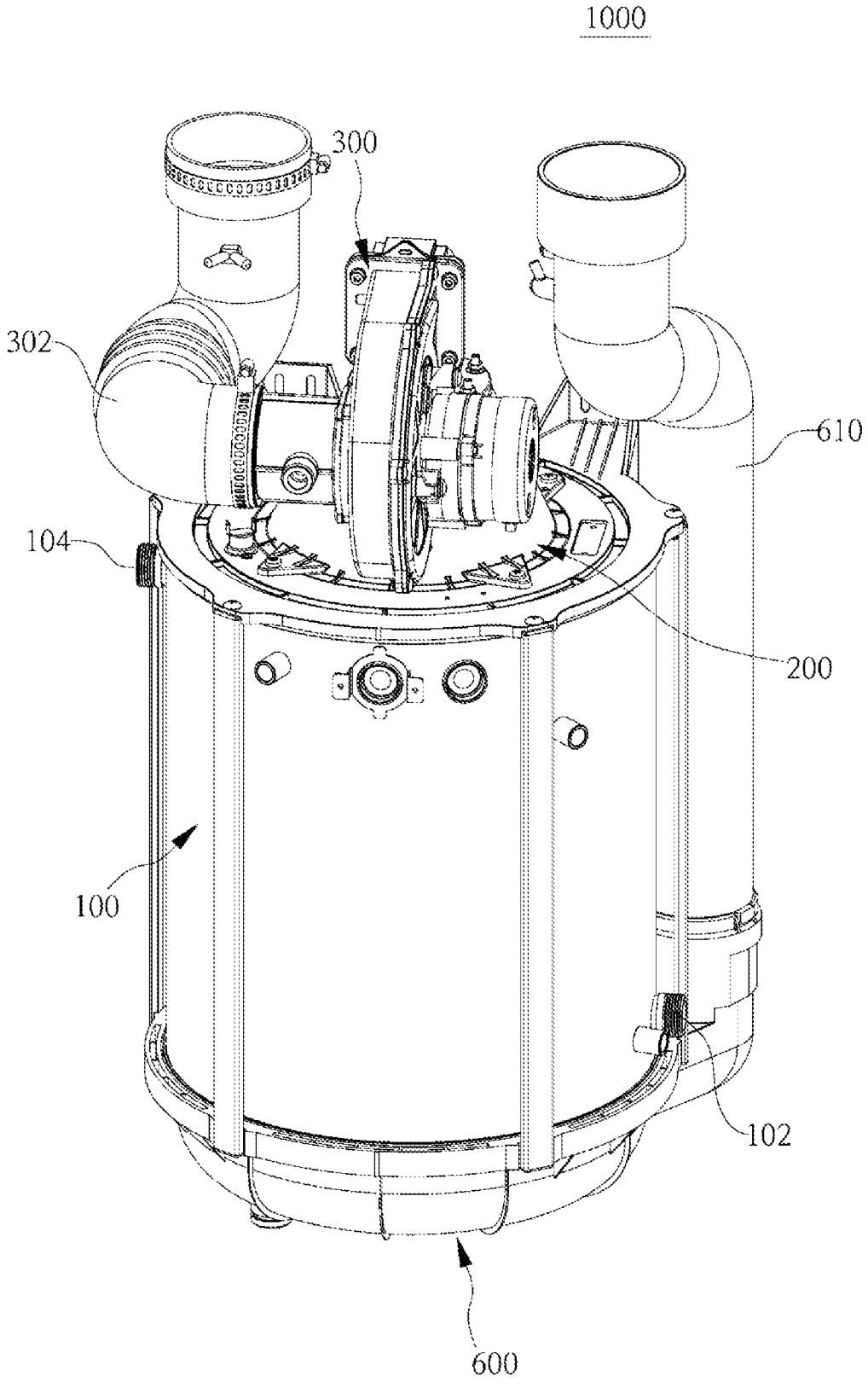
FIG. 2 is a view schematically illustrating a hot water storage-type boiler having both a heat amount proportional control function and a backflow prevention function according to a preferred embodiment of the present invention.
Figure 3:
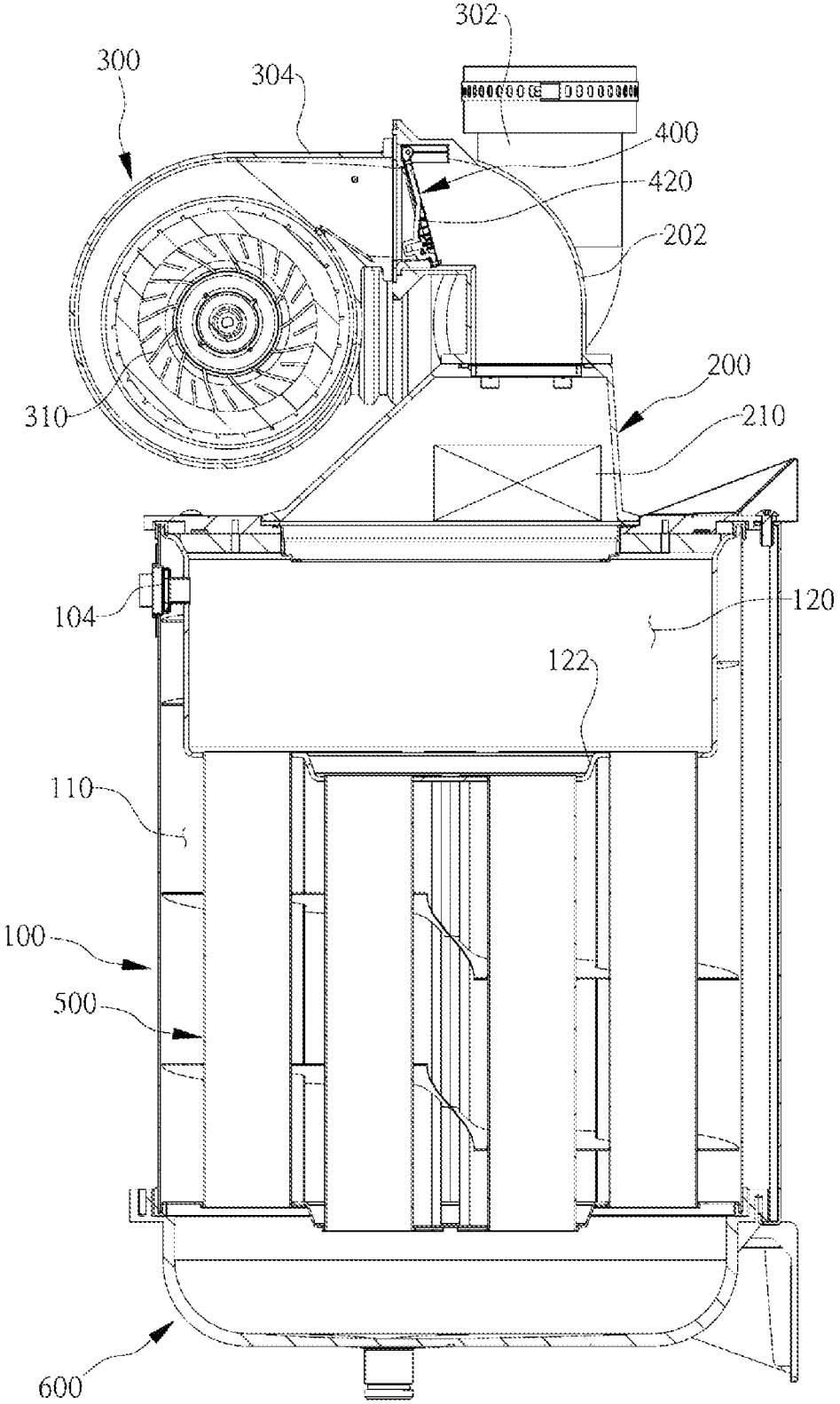
FIG. 3 is a schematic cross-sectional view of the hot water storage-type boiler having both the heat amount proportional control function and the backflow prevention function according to the preferred embodiment of the present invention.

FIG. 2 is a view schematically illustrating the hot water storage-type boiler having both the heat amount proportional control function and the backflow prevention function according to the preferred embodiment of the present invention. FIG. 3 is a schematic cross-sectional view of the hot water storage-type boiler having both the heat amount proportional control function and the backflow prevention function according to the preferred embodiment of the present invention.

Referring to FIGS. 2 and 3, the hot water storage-type boiler 1000, which has both the heat amount proportional control function and the backflow prevention function according to the preferred embodiment of the present invention, has a casing 100, a burner body 200, a blower body 300, a check valve 400, a fire tube 500, and an exhaust gas part 600.

The casing 100 is provided in a circular pillar shape having an empty space 110 therein and having an upper portion roughly opened. In addition, an inlet part 102 is provided at a lower portion of the casing 100 so that water is supplied into the casing 100 from the outside, and an outlet part 104 is provided at the upper portion of the casing 100. Direct water supplied into the casing 100 through the inlet part 102 is heated through the fire tube 500 to be described later, and heated hot water is discharged to the outside through the outlet part 104. In addition, a firebox 120 is provided in a roughly circular column shape so that an independent space is provided in an upper portion of the space 110 of the casing 100. Then, an outer circumferential edge of the firebox 120 is provided to be smaller than an inner circumferential edge of the casing 100 so that an empty space is provided between the outer circumferential edge of the fire box 120 and the inner circumferential edge of the casing 100. When the water supplied into the casing 100 is heated by the fire tube 500, the heated hot water is guided to the empty space and then discharged to the outside of the casing 100 through the outlet part 104.

The burner body 200 is mounted on an upper portion of the firebox 120, and a burner 210 is mounted therein. The burner 210 is mounted in the burner body 200 to inject a flame into the fire box 120. Such a burner 210 has a conventional configuration that generates the flame by properly mixing a fuel such as gas with air and burning the mixed fuel. When the flame is injected into the firebox 120 from the burner 210, combustion gas with a high temperature due to the flame is generated in the firebox 120.

The blower body 300 is positioned on one side of the burner body 200, and a blower 310 is provided therein. The blower 310 has a conventional configuration that produces air flow. In addition, a blower pipe 304 is provided on one side of the blower body 300 so that the outside air flows into the inside of the blower body 300. Also, a blower duct 302 extends to deliver outside air sent by the blower 310 to the burner body 200 at the other side of the blower body 300. Then, a burner duct 202 extends in a direction of the blower duct 302 to be connected to the blower duct 302 on an upper portion of the burner body 200.

The check valve 400 is provided in the blower duct 302 or the burner duct 202. In an exemplary embodiment of the present invention, the check valve 400 is provided on an upper side of the burner duct 202 coupled to the blower duct 302. This check valve 400 is configured to be opened by a pressure of air supplied from the blower 310, and is configured to be closed by a pressure of gas generated by the flame injected by the burner 210. A detailed structure of the check valve 400 is described later. Since the check valve 400 is integrally coupled to the burner duct 202 in this way, there is an effect of convenient assembly. In addition, since the check valve 400 is built in the burner duct 202, the check valve 400 does not protrude to the outside. Thus, there is an effect that a separate space is not required.

The fire tube 500 is provided, for example, in a hollow pillar shape, and one end thereof is connected to penetrate through a lower surface unit of the fire box 122 located at a lower portion of the fire box 120, and the other end thereof is connected to penetrate through a lower surface of the casing 100. This fire tube 500 may be configured in plural and may be arranged radially inside the casing 100. When hot combustion gas generated in the firebox 120 is delivered to inside of the fire tube 500, the fire tube 500 is heated to the high temperature by heat of the combustion gas. In addition, the combustion gas which passed the fire tube 500 is exhausted to the exhaust gas part 600 to be described later. As such, the fire tube 500 is heated to the high temperature by the combustion gas via flame of the burner 210, so that the direct water supplied into the casing 100 is heat-exchanged with hot water.

The exhaust gas part 600 is mounted on a lower side of a lower surface of the casing 100, and exhausts the combustion gas, exhaust gas, and the like that have discharged from the fire tube 500 to the outside. To this end, the exhaust gas part 600 is further provided with an exhaust gas duct 610 connected to the outside.

Figure 4:
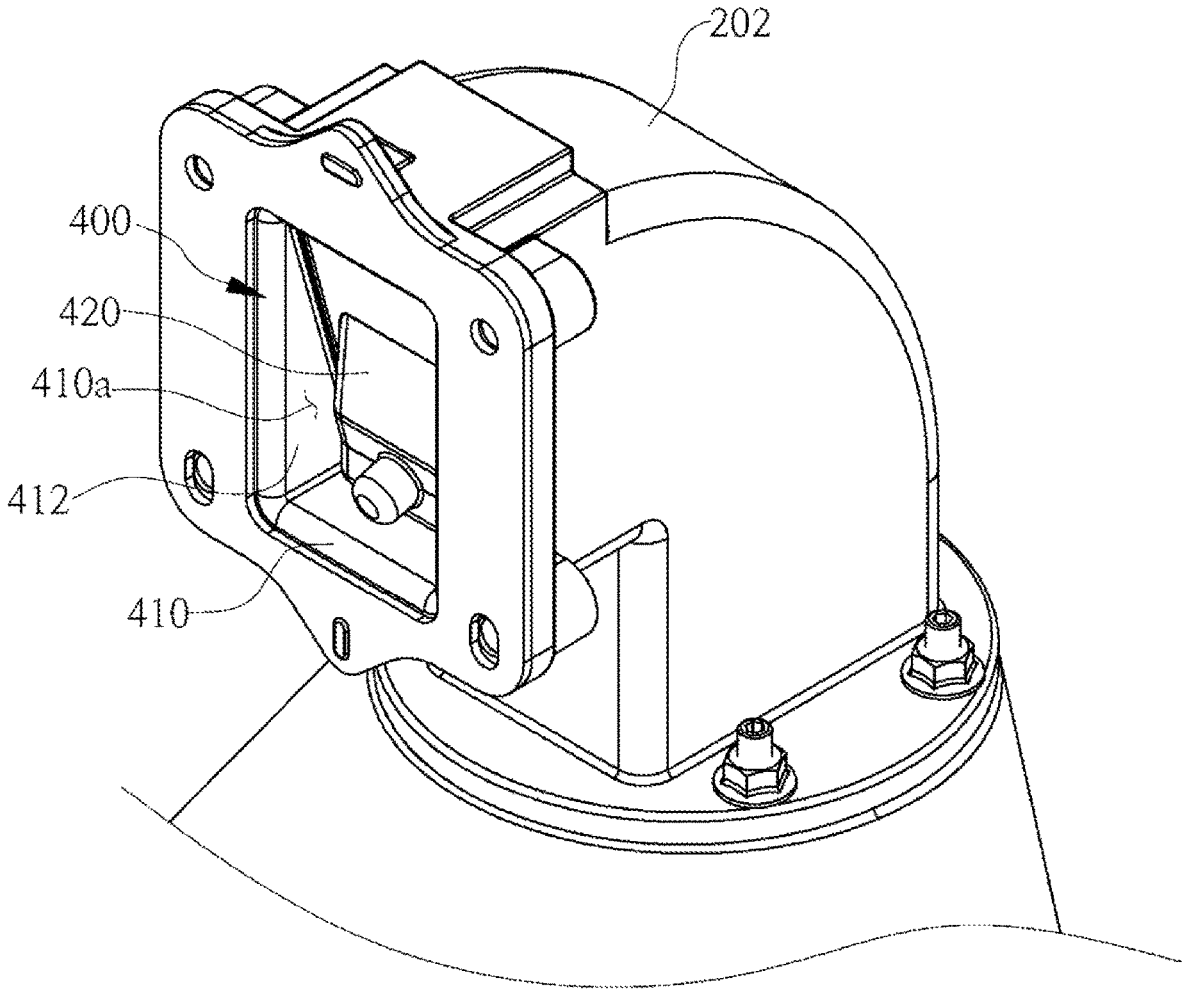
FIG. 4 is a view schematically illustrating a state in which a check valve of the hot water storage-type boiler having both the heat amount proportional control function and the backflow prevention function according to the preferred embodiment of the present invention is installed in a burner duct.
Figure 5:
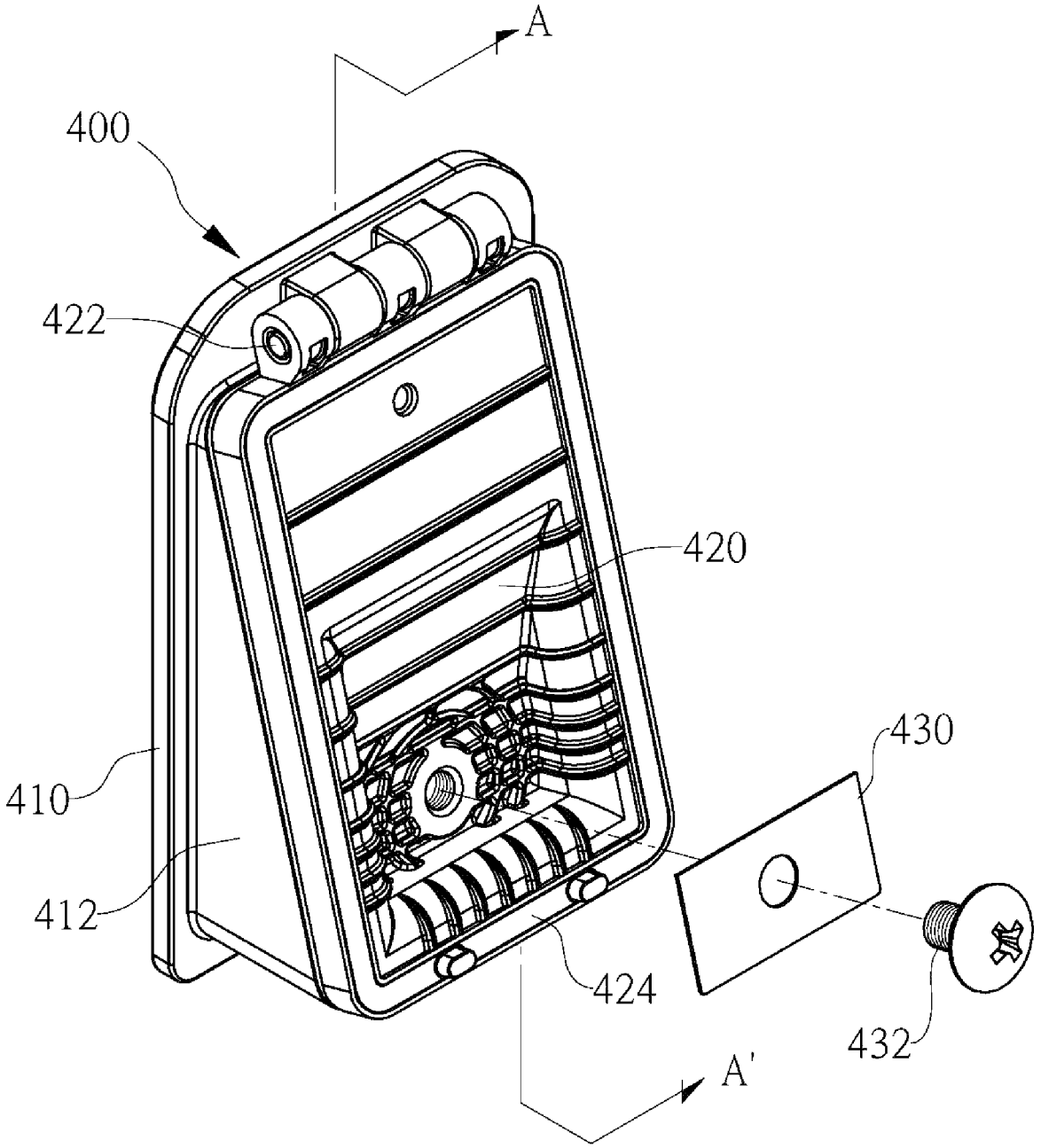
FIG. 5 is an exploded view illustrating the check valve of the hot water storage-type boiler having both the heat amount proportional control function and the backflow prevention function according to the preferred embodiment of the present invention.

FIG. 4 is a view schematically illustrating a state in which the check valve of the hot water storage-type boiler having both the heat amount proportional control function and the backflow prevention function according to the preferred embodiment of the present invention is installed in the burner duct. FIG. 5 is an exploded view illustrating the check valve of the hot water storage-type boiler having both the heat amount proportional control function and the backflow prevention function according to the preferred embodiment of the present invention.

Referring to FIGS. 4 and 5, the check valve 400 may include a valve body 410 which is fitted to an inner circumference edge of the burner duct 202. In addition, the check valve 400 may include an opening and closing part 420 which is coupled to an upper portion of the valve body 410 to be rotated and provided to open and close the valve body 410. Also, the check valve 400 may further include a weight plate 430 detachably coupled to the opening and closing part 420.

The valve body 410 is provided to be fitted to an end of the burner duct 202, and a penetration part 410*a* is provided through one surface thereof. A guider 412 protrudes toward the burner 210 along an edge of the valve body 410. Here, the guider 412 protrudes in an inclined state to recede from the edge of the valve body 410 toward a lower side of the valve body 410.

The opening and closing portion 420 is hinged to an upper side of the valve body 410 by a hinge pin 422 and is installed to be rotatable. The opening and closing part 420 is inclined to be closely adhered to the guider 412 to close the penetration part 410*a* or rotate away from the guider 412 to open the penetration part 410*a*.

The weight plate 430 is detachably coupled to the opening and closing part 420, and is provided with the weight plate 430 of various weights. In some cases, a heavy weight plate 430 may be mounted on the opening and closing part 420, or a light weight plate 430 may be mounted on the opening and closing part 420, thereby adjusting the weights of the weight plate 430. This is for controlling the turn down ratio (TDR) of combustion, and TDR refers to the 'a ratio of maximum gas consumption to minimum gas consumption' in a gas combustion device in which an amount of gas is variably controlled. The turndown ratio (TDR) indicates how stable the flame may be at minimum gas consumption conditions. In addition, the lighter the weight plate 430 is, the wider an opening area of the opening and closing part 420 is, the more significant an amount of air flowing into the burner 210 from the outside is, thus the burner 210 may stably maintain the flame. On the contrary, the heavier the weight plate 430 is, the narrower the opening area of the opening and closing part 420 is, and thus the amount of air flowed into the burner 210 from the outside is relatively small, and the flame of the burner 210 also becomes unstable. As such, the present invention has an effect of controlling the turndown ratio by adjusting the weights of the weight plate 430.

Figure 6:
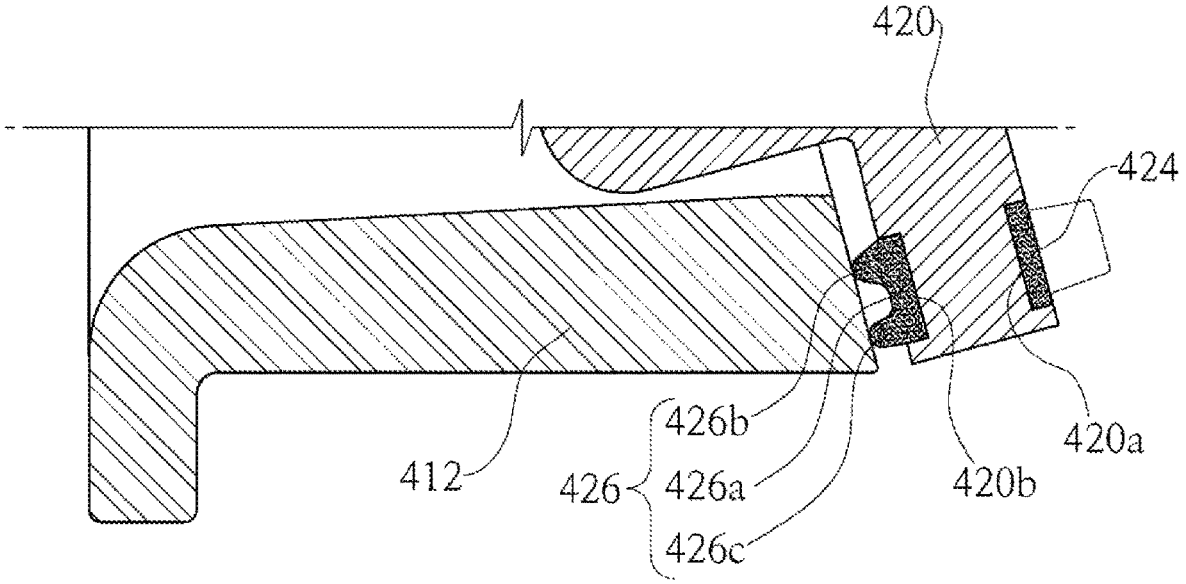
FIG. 6 is a view illustrating a cross-section taken along line A-A' of FIG. 5.

FIG. 6 is a view illustrating a cross-section taken along line A-A' of FIG. 5.

Referring to FIGS. 5 and 6, an inner recess 420*b* is provided along an inner side edge of the opening and closing part 420 in contact with the guider 412 of the valve body 410, and an outer recess 420*a* is provided along an outer side edge of the opening and closing part 420 positioned in the opposite direction of the inner recess 420*b*. In addition, a rubber inner side sealing unit 426 is mounted on the inner recess 420*b*, and a rubber outer side sealing unit 424 is mounted on the outer recess 420*a*.

Here, the inner side sealing unit 426 includes a fitting unit 426*a* fitted to the inner recess 420*b*, a first protrusion unit 426*b* protruding in a direction of the guider 412 along one edge of the fitting unit 426*a*, and a second protrusion unit 426*c* protruding in the direction of the guider 412 along the other edge of the fitting unit 426*a*. As such, since the inner side sealing unit 426 has a double protrusion, that is, the first and second protrusion units 426*b* and 426*c*, the inner side sealing unit 426 is closely adhered to the guider 412, and thus airtightness is improved. In addition, the opening and closing part 420 and the inner side and outer side sealing units 426 and 424 are manufactured by double injection, thereby reducing the production cost.

Figure 7A:
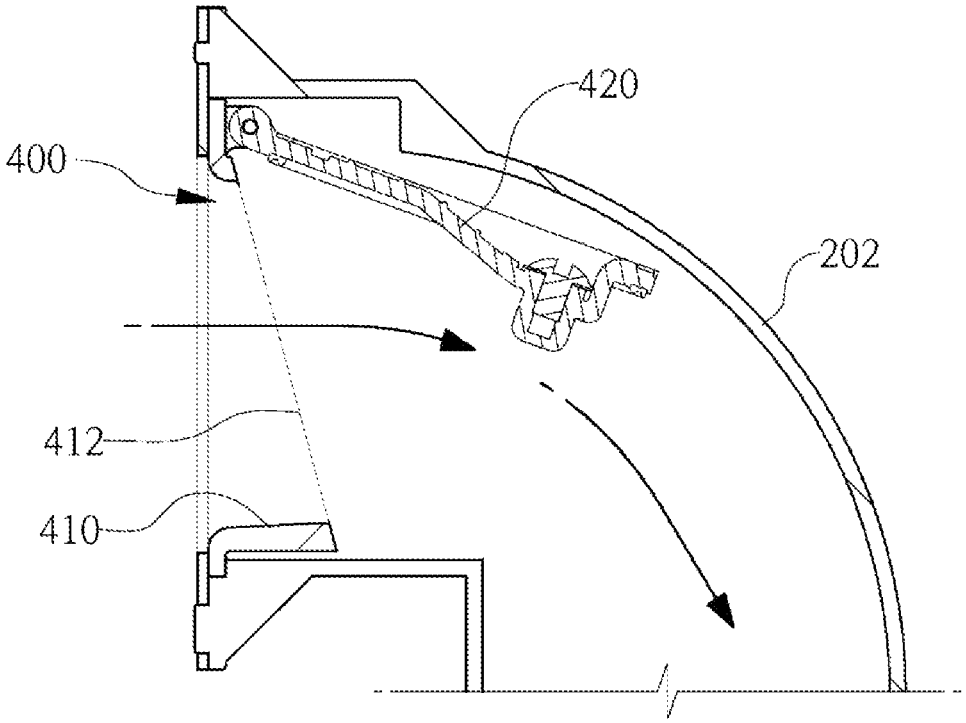
FIGS. 7A and 7B are views illustrating a state in which the check valve of the hot water storage-type boiler having both the heat amount proportional control function and the backflow prevention function according to the preferred embodiment of the present invention opens and closes the burner duct.
Figure 7B:
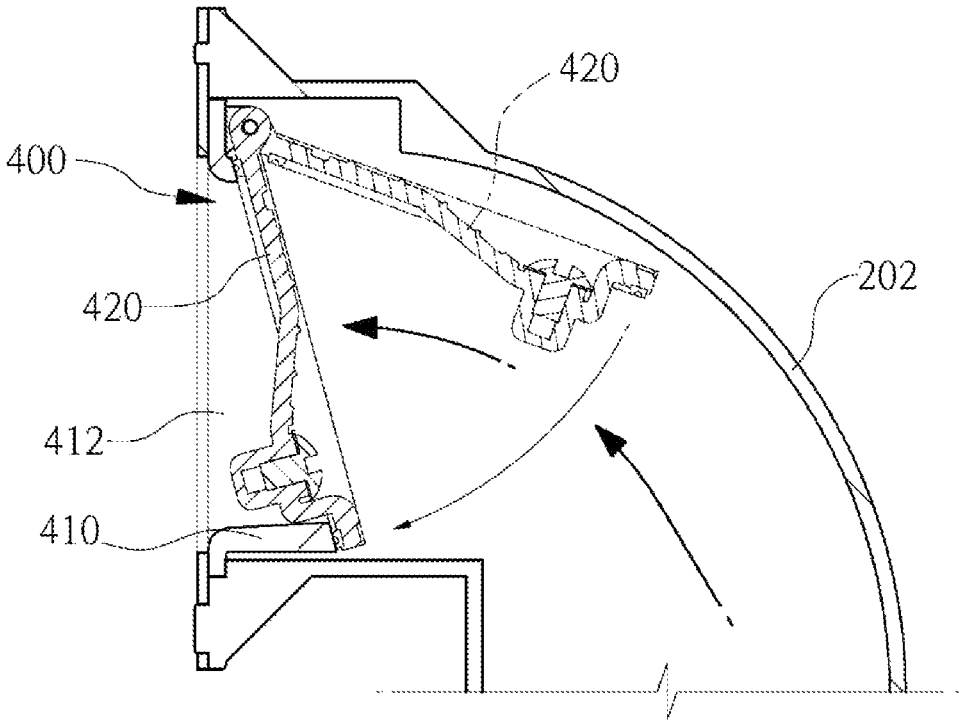

FIGS. 7A and 7B are views illustrating a state in which the check valve of the hot water storage-type boiler having both the heat amount proportional control function and the backflow prevention function according to the preferred embodiment of the present invention opens and closes the burner duct.

First, referring to FIG. 7A, the opening and closing part 420 is closely adhered to the guider 412 to close the penetration part 410*a* by a pressure of the weight plate 430. In this state, the opening and closing part 420 is rotated forward in the outward direction of the guider 412 by the pressure of the air supplied from the blower 310. Then, the opening and closing part 420 opens the penetration part 410*a*, and outside air is supplied toward the burner 210 through the penetration part 410*a*. Since the opening area of the opening and closing part 420 of the check valve 400 is variable by the pressure of the air supplied from the blower 310, the air supplied from the blower 310 to the burner body 200, precise amount of oxygen is also variable, through which the effect of heat amount proportional control is made possible.

Subsequently, referring to FIG. 7B, the opening and closing part 420 is reversely rotated in a direction in which the burner 210 is closely adhered to the guider 412 by the pressure of the gas generated by the flame injected by the burner 210. Then, the opening and closing part 420 closes the penetration part 410*a*, and when the penetration part 410*a* is closed, thus there is an effect that the gas generated by the burner 210 is prevented from flowing back.

Although the present invention has been described in detail in the above embodiment, it is obvious that the present invention is not limited thereto. It is apparent that those skilled in the art will appreciate that various modifications and variations are possible within the scope of the present invention. If such variations and modifications fall within the scope of the appended claims, their technical spirit should also be regarded as belonging to the present invention.

The invention claimed is:

1. A hot water storage-type boiler having both a heat amount proportional control function and a backflow prevention function, the hot water storage-type boiler comprising:

a casing having a space therein and providing an independent firebox on an upper portion of the space;

a burner body mounted on an upper portion of the firebox and provided therein with a burner to inject a flame into the firebox;

a blower body connected to the burner body and provided therein with a blower to send air to the burner body;

a check valve provided on one side of the burner body coupled to the blower body or on one side of the blower body coupled to the burner body, and moving the air supplied from the blower toward the burner, wherein the check valve is configured to be opened by pressure of the air supplied from the blower and to be closed by pressure of gas generated by the flame injected by the burner, further comprising;

a plurality of fire tubes, one side thereof is connected to a lower surface of the firebox and the other side thereof extends to a lower direction of the space; and an exhaust gas part provided at a lower portion of the casing and connected to the fire tubes, wherein the boiler is configured to permit the flame injected by the burner to move along insides of the fire tubes while heating the fire tubes and then to move to the exhaust gas part, and water supplied to one side of the space to move to the other side of the space after passing through the space, wherein the blower body comprises a blower duct that extends at one side of the blower body and is configured to deliver outside air sent by the blower to the burner body, wherein the burner body comprises a burner duct that extends in a direction of the blower duct to be connected to the blower duct, wherein the check valve is provided inside the blower duct or the burner duct, wherein the check valve comprises:

a valve body that is fitted into an inner circumferential edge of the blower duct or the burner duct and has a penetration part provided on one surface thereof; and an opening and closing part configured to open and close the penetration part and configured to be hinge-coupled to the valve body to be opened in a direction of the burner, wherein the opening and closing part comprises:

an inner recess provided inside the opening and closing part in contact with the valve body; and an inner sealing unit mounted in the inner recess, wherein the inner recess and the inner side sealing unit are configured to prevent the gas generated by the flame injected by the burner from flowing back, wherein the check valve further comprises:

a weight plate attached to a concave area of the opening and closing part, wherein an area provided with the weight plate and the concave area of the opening and closing part is formed by denting from an outside to an inside of the check valve and is configured not to collide with the burner duct when the opening and closing part opens the penetration part, and wherein the check valve further comprises:

an outer recess formed on an outer side of the opening and closing part; and an outer sealing unit that is mounted in the outer recess and has a protrusion, wherein the protrusion is configured to absorb impact while abutting on the burner duct when the opening and closing part opens the penetrating part.

2. The hot water storage-type boiler having both a heat amount proportional control function and a backflow prevention function of claim 1, further comprising a guider protruding toward the burner along an edge of the valve body, wherein the guider protrudes in an inclined state to recede from the edge of the valve body toward a lower side of the valve body, and the opening and closing part is closely adhered to be inclined to the guider in a hinged state on an upper side of the valve body.

3. The hot water storage-type boiler having both a heat amount proportional control function and a backflow prevention function of claim 1, wherein the weight plate is detachably coupled to the opening and closing part and configured to adjust weights of the weight plate.

4. The hot water storage-type boiler having both a heat amount proportional control function and a backflow prevention function of claim 1, wherein the sealing unit has a double protrusion.

* * * * *